US009500087B2

(12) United States Patent
Davis

(10) Patent No.: US 9,500,087 B2
(45) Date of Patent: Nov. 22, 2016

(54) IMPINGEMENT COOLING OF GAS TURBINE BLADES OR VANES

(75) Inventor: Anthony Davis, Lincoln (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 505 days.

(21) Appl. No.: 13/996,054

(22) PCT Filed: Dec. 2, 2011

(86) PCT No.: PCT/EP2011/071598

§ 371 (c)(1),
(2), (4) Date: Jun. 20, 2013

(87) PCT Pub. No.: WO2012/084454

PCT Pub. Date: Jun. 28, 2012

(65) Prior Publication Data

US 2013/0272896 A1 Oct. 17, 2013

(30) Foreign Application Priority Data

Dec. 22, 2010 (EP) ..... 10196512

(51) Int. Cl.
*F01D 5/18* (2006.01)

(52) U.S. Cl.
CPC ..... *F01D 5/189* (2013.01); *F05D 2230/51* (2013.01); *F05D 2230/60* (2013.01); *F05D 2260/201* (2013.01); *F05D 2260/30* (2013.01); *Y10T 29/49359* (2015.01)

(58) Field of Classification Search
CPC ..... F01D 5/189
USPC ..... 416/96 A
See application file for complete search history.

(56) References Cited

U.S. PATENT DOCUMENTS

| | | | | |
|---|---|---|---|---|
| 3,715,170 A | | 2/1973 | Anderson | |
| 4,105,364 A | * | 8/1978 | Dodd | F01D 5/189 415/115 |
| 4,413,949 A | * | 11/1983 | Scott | F01D 5/189 416/96 A |
| 4,482,295 A | * | 11/1984 | North | F01D 5/189 415/115 |
| 4,504,189 A | * | 3/1985 | Lings | F01D 5/141 415/115 |
| 4,796,515 A | | 1/1989 | Koffel | |
| 4,798,515 A | | 1/1989 | Hsia | |
| 5,120,192 A | * | 6/1992 | Ohtomo | F01D 5/189 415/115 |

(Continued)

FOREIGN PATENT DOCUMENTS

| | | |
|---|---|---|
| DE | 4441507 A1 | 5/1995 |
| EP | 1380725 A2 | 1/2004 |

(Continued)

OTHER PUBLICATIONS

Orlov P.L.; "Design principles"; vol. 2; pp. 97-99; 1988.

*Primary Examiner* — Richard Edgar

(57) ABSTRACT

A turbine component includes a hollow aerofoil and an impingement tube located within the hollow aerofoil. The impingement tube is formed from at least two separate sections each extending span wise through the hollow aerofoil. Adjacent sections of the impingement tube are connected together by a locking device. The locking device is insertable into the hollow aerofoil and locks the impingement tube into place in the hollow aerofoil. The locking device is a roll pin being located in an axially direction between said sections and has a main extension which extends in a radial direction of the hollow aerofoil.

8 Claims, 1 Drawing Sheet

(56) References Cited

U.S. PATENT DOCUMENTS

| | | | | |
|---|---|---|---|---|
| 5,288,207 | A | 2/1994 | Linask | |
| 5,419,039 | A | 5/1995 | Auxier | |
| 5,533,864 | A | 7/1996 | Ito | |
| 6,742,984 | B1 | 6/2004 | Devine, II | |
| 7,056,083 | B2 | 6/2006 | Gray | |
| 7,104,756 | B2 * | 9/2006 | Harding | F01D 5/189 416/233 |
| 2004/0109763 | A1 * | 6/2004 | Ciacci | F01D 5/189 416/97 R |
| 2005/0220626 | A1 | 10/2005 | Gray | |

FOREIGN PATENT DOCUMENTS

| | | | |
|---|---|---|---|
| EP | 1452690 | A2 | 9/2004 |
| EP | 1626162 | A1 | 2/2006 |
| GB | 1605194 | A | 4/1983 |
| WO | WO 2010131385 | A1 | 11/2010 |

* cited by examiner

IMPINGEMENT COOLING OF GAS TURBINE BLADES OR VANES

CROSS REFERENCE TO RELATED APPLICATIONS

This application is the US National Stage of International Application No. PCT/EP2011/071598 filed Dec. 2, 2011 and claims benefit thereof, the entire content of which is hereby incorporated herein by reference. The International Application claims priority to the European application No. 10196512.7 EP filed Dec. 22, 2010, the entire contents of which is hereby incorporated herein by reference.

FIELD OF THE INVENTION

The present invention relates to aerofoil-shaped gas turbine components such as gas turbine rotor blades and stator vanes, and to impingement tubes used in such components for cooling purposes. The present invention further relates to a method for assembling impingement tubes in such components.

BACKGROUND TO THE INVENTION

Modern gas turbines often operate at extremely high temperatures. The effect of temperature on the turbine blades and/or stator vanes can be detrimental to the efficient operation of the turbine and can, in extreme circumstances, lead to distortion and possible failure of the blade or vane. In order to overcome this risk, high temperature turbines may include hollow blades or vanes incorporating so-called impingement tubes for cooling purposes.

These so-called impingement tubes are hollow tubes that run radially within the blades or vanes. Air is forced into and along these tubes and emerges through suitable apertures into a void between the tubes and a interior surfaces of the hollow blades or vanes. This creates an internal air flow to cool the blade or vane.

Normally, blades and vanes are made by casting having hollow structures. Impingement tubes may be inserted into the hollow structure from one or other end and usually welded with the hollow structure to fix them in place. Chordal ribs are also often cast inside the blades, mainly to direct coolant and to provide a greater cooling surface area. These ribs, or specially cast ribs, may serve as location spacers for the impingement tubes, so as to create the necessary internal space for the cooling air.

Problems arise with fitting impingement tubes into the blades or vanes. Aerofoil sections of the blades or vanes may be extremely complicated. Hollow aerofoils may feature multidirectional curvature (complex shapes having 3-dimensional curvature) to improve an aerodynamic efficiency of the aerofoil, and hence increasing efficiency of the gas turbine. The amount of curvature and twist permitted on the aerofoil is limited by a need for the impingement tube to slide in from one end of the aerofoil.

Several techniques for enabling an impingement tube to be fitted inside such a hollow turbine blade or vane are known. U.S. Pat. No. 7,056,083 B2 discloses a turbine blade or vane with an impingement tube for cooling purposes located generally in a radial direction within the hollow blade or vane aerofoil. The impingement tube comprises two parts extending into the hollow aerofoil from opposite radial ends thereof and locating against a specially formed rib which extends generally chord wise around a leading edge of the aerofoil. The impingement tube is assembled from both ends of the hollow aerofoil and located against the formed rib approximately half way between the apertures of a cavity.

U.S. Pat. No. 4,798,515 A discloses a cooling arrangement for stator vanes for a turbo machine. Inside a cavity of the stator vane two impingement cooling inserts are arranged. They are brazed or force fitted via flared resilient portions of the inserts into inlet apertures of trunnions of the vane. The two impingement cooling inserts are inserted into the cavity from opposite ends of the vane. For connecting the two impingement cooling inserts to one another a positioning pin is provided at the impingement cooling insert which interacts with a positioning pin receptacle at the impingement cooling insert.

In U.S. Pat. No. 6,742,984 B1 a gas turbine having inserts for impingement-cooling of walls of a nozzle vane is shown. Each insert has two parts which are inserted successively inside a cavity of the vane so that they are arranged in the cavity at a same axial height from a leading to a trailing edge. The inserts are secured into position in the cavity by a welding or brazing operation. A leg section of each part of an insert extends in radial direction of the vane. Supporting rods, which extend perpendicular to the radial direction, are arranged between the leg sections to space them apart from one another. Moreover, these supporting rods are provided for maintaining standoffs at outer walls of the leg sections engaged against inner wall surfaces of the nozzle vane walls.

EP 1 626 162 A1 describes a vane assembly with a vane used in a gas turbine. A first and a second baffle of a baffle assembly are inserted into a cavity of the vane from opposite ends of the vane so that they are arranged in span wise direction radially one over the other. Further, the baffles are fixed to one another radially and inside the cavity by means of a fastener, which applies a spanwisely directed tensile load to the vane.

It is a first objective of the present invention to provide a method for assembling an impingement tube in a hollow aerofoil of an aerofoil-shaped gas turbine component such as gas turbine rotor blade and stator vane which the above-mentioned shortcomings can be mitigated, and especially a more aerodynamic efficient aerofoil and gas turbine component is facilitated.

It is a second objective of the invention to provide an advantageous aerofoil-shaped gas turbine component such as a gas turbine rotor blade and a stator vane. A third objective of the invention is to provide an advantageous impingement tube used in such a component for cooling purposes.

SUMMARY OF THE INVENTION

Accordingly, the present invention provides a turbine component comprising a hollow aerofoil and an impingement tube located within the hollow aerofoil. The impingement tube is being formed from at least two separate sections each extending span wise through the hollow aerofoil. Adjacent sections of said impingement tube are connected—physically (directly as well as indirectly using spacers, adapter or intermediate part) as well as functionally—together by a locking means, wherein said locking means locking said impingement tube into place in the hollow aerofoil. Said locking means is arranged in an axially direction between said sections and has a main extension which extends in a radial direction of the hollow aerofoil.

The invention further provides an impingement tube for location within a hollow aerofoil of a turbine component. The impingement tube comprises at least two separate sections each for extending span wise through the hollow aerofoil. Adjacent sections of said impingement tube are connected together by a locking means, wherein said locking means are provided to lock said impingement tube into place in the hollow aerofoil. Said locking means is arranged in an axially direction between said sections and has a main extension which extends in a radial direction of the hollow aerofoil.

The present invention also provides a method for assembling an impingement tube in a hollow aerofoil of a turbine component. The impingement tube is being formed from at least two separate sections each extending span wise through the hollow aerofoil. Said method comprises the steps of

- inserting a first of said at least two sections of the impingement tube into the hallow aerofoil and manoeuvring said first section in direction of a trailing edge region of the hollow aerofoil into position in a rear of a cavity of the hallow aerofoil,
- inserting a second of said at least two sections of the impingement tube into the hallow aerofoil adjacent to said first section—and if needed but not obligatory manoeuvring said second section into position in the hallow aerofoil,
- connecting said first and second section together by a locking means, which is arranged in an axially direction between said sections and has a main extension which extends in a radial direction of the hollow aerofoil and thus locking said impingement tube into place in the hollow aerofoil.

The invention is based on the insight that the limitation in curvature and twist of a hollow aerofoil could be avoided by using a two or more part impingement tube wherein each part/section could be assembled individually in the hollow aerofoil. A locking means fitted between adjacent sections will lock the impingement tube into place in the hollow aerofoil.

According to the inventive solution the use of a two or more part impingement tube, especially the possibility of an individual assembling of a section, allows a greater, more complex curvature and twist of the aerofoil section which increases the aerodynamic efficiency of the aerofoil and hence the efficiency of the turbine—by avoiding mounting inadequacy.

Thus, an impingement tube could be split in two or more sections. Each section may then be slid in the hallow aerofoil, i.e. in a cavity of the hallow aerofoil, individually and then moved in their correct chordal location. The two or more part impingement tube is locked—and hold—into place by use of the locking means, for example such as hypodermic tubes or roll pins, between adjacent sections.

Depending on a size of the hollow aerofoil, i.e. the size of the cavity of the hollow aerofoil, one, two or more of such locking means according to the invention could be used. Only one locking means could be sufficient for a small hollow aerofoil; a bigger hollow aerofoil could require more of such locking means to hold the sections and the impingement tube in place.

By using such locking means the sections of the impingement tube will be mechanically joined in an axial direction—in direction of a leading edge and a trailing edge of the hollow aerofoil—that are located in a fore and rear of the hollow aerofoil. It could be advantageous for a straight seat if said hollow aerofoil comprises protrusions or locking pins or ribs at an interior surface of said hollow aerofoil.

In an advantageous embodiment the impingement tube being formed from two separate sections, particularly as a fore and an rear section of said impingement tube wherein said fore section could be located in a fore of said hollow aerofoil and/or said rear section could be located in a rear of said hallow aerofoil. While assembling the sections into the hollow aerofoil it is advantageous first to insert the rear section in the hollow aerofoil followed by the fore section.

But it is also conceivable that the impingement tube being formed from three separate sections, particularly as a fore, middle and an rear section of said impingement tube wherein said fore section could be located in a fore of said hollow aerofoil, said middle section could be located in a middle of said hollow aerofoil and/or said rear section could be located in a rear of said hallow aerofoil. The locking means are taken in between adjacent sections. An order while assembling the sections could be with the rear section first, following the middle section and the fore section third. The order of assembling the middle and the fore section could also be reverse with the fore section following the middle section.

In an embodiment of the invention at least one of said at least two separate sections could extend substantially completely through a span of the hollow aerofoil. But it is also conceivable that at least one of said at least two separate sections would be split further into at least two radial segments—similar to radially split impingement tubes as known from U.S. Pat. No. 7,056,083 B2.

"Radial" in this respect means a direction between a first platform and a second platform between which the hollow aerofoil extends. "Radial" refers to an assembled gas turbine engine comprising a plurality of aerofoils that are arranged about an axis of rotation of the gas turbine engine and extending through an annular flow path.

It is further advantageous if said fore section have substantially the same contour as an interior surface of a fore of said hollow aerofoil and/or said rear section have substantially the same contour as an interior surface of a rear of said hollow aerofoil.

Advantageously, said hollow aerofoil comprises a single cavity. But the invention could also be realized for a hollow aerofoil comprising two or more cavities each of them comprising the segmented impingement tube according to the invention. In a further advantageous embodiment the turbine component is turbine blade or vane, for example a nozzle guide vane.

BRIEF DESCRIPTION OF THE DRAWINGS

The present invention will be described with reference to drawings in which.

DETAILED DESCRIPTION OF THE ILLUSTRATED EMBODIMENT

In the present description, reference will only be made to a vane (nozzle guide vane) as an aerofoil, for the sake of simplicity, but it is to be understood that the invention is applicable to both blades and vanes of a turbine, particularly of a gas turbine. Such a vane or blade may be assembled between platforms that define boundaries for a fluid flow path. The platforms and the aerofoil may also be a single piece, e.g. produced by casting. Considering an axis of rotation about which rotor parts of the gas turbine will evolve, the platforms extend in an axial and a circumferential direction. The blades or vanes extend substantially in radial direction in relation to the axis of rotation.

Figure 1:
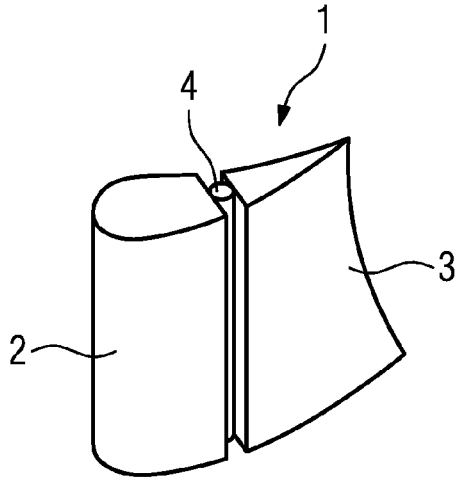
FIG. 1: shows a perspective view of a two-part impingement tube with two separate sections/segments connected by a roll pin.

As shown in FIG. 1, an impingement tube 1 for cooling purpose in a nozzle guide vane 5 has two sections/segments, a fore section 2 and a rear section 3. Both sections 2, 3 will be connected to another by a roll pin 4 to lock the impingement tube 1 in place in a cavity 6 of the hollow nozzle guide vane 5.

Figure 2:
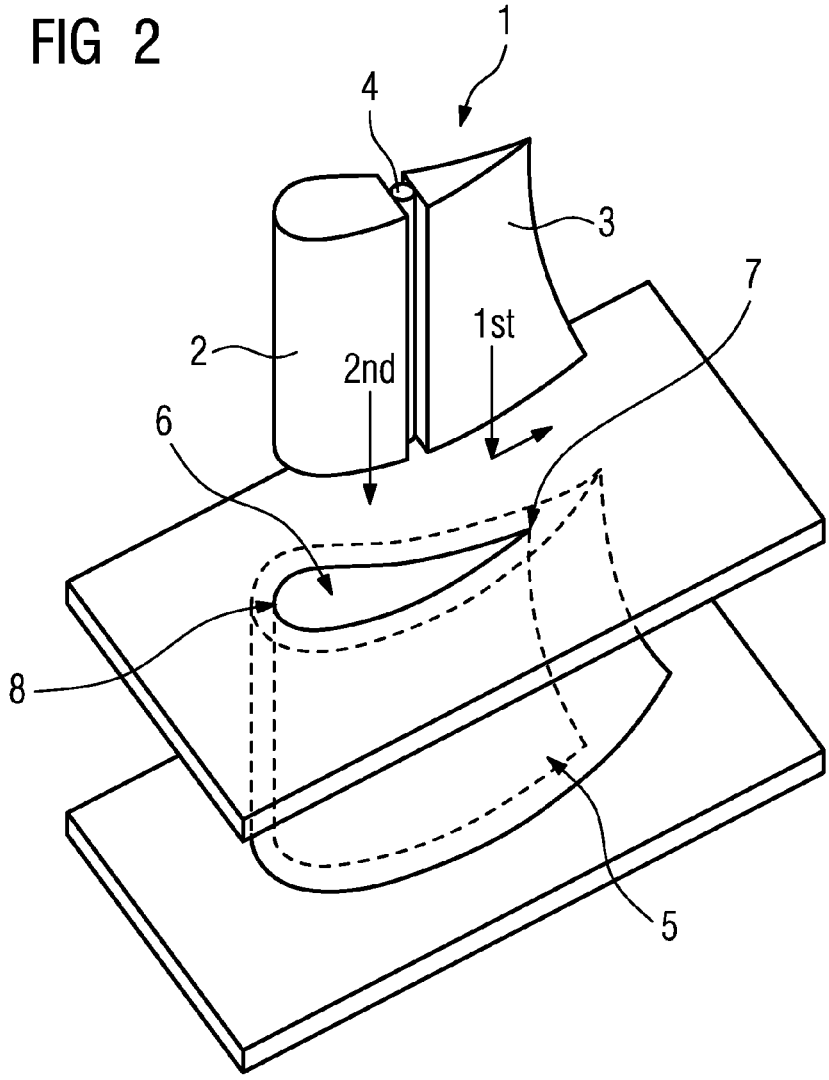
FIG. 2: shows a drawing of assembling a two-part impingement tube inside a cavity of a hollow vane.

As shown in FIG. 2, the impingement tube 1 is inserted into the cavity 6 of the hollow nozzle guide vane 5 while inserting the rear section 3 in the cavity 6 from one radial end of the cavity 6 first. The rear section 3 will be manoeuvred into position in a rear 7 of the cavity 6 of the hollow nozzle guide vane 5, which rear 7 having substantially the same contour/shape as the rear section 3.

Then the fore section 2 of the impingement tube is inserted in the cavity 6 from the radial end of the cavity 6 and will—if needed—also be manoeuvred into place in a fore 8 of the cavity 6 of the hollow vane 5, which fore 8 having substantially the same contour/shape as the for section 2.

Finally the roll pin 4 is fitted to lock the impingement tube 1 in place in the cavity 6 of the nozzle guide vane 5. The roll pin 4 is arranged in axial direction between the sections 2, 3 and has a main extension which extends in radial direction of the vane 5.

In other words, the rear section 3 is first inserted into the cavity 6 by a radial movement, radial inwards or radial outwards. After the radial movement, the rear section 3 will experience a further movement in direction of a trailing edge region of the hollow vane 5. Once in place, the fore section 2 is inserted into the cavity 6 again by a substantially pure radial movement into the leading edge region of the hollow vane 5.

Particularly the fore and the rear sections 2, 3 will be inserted from the same side, i.e. from a radial outwards side or from a radial inwards side.

"Leading" and "trailing" defines the airflow around the aerofoil. The leading edge is substantially a cylindrical section whereas the trailing edge is a sharp edge.

The use of more than one impingement tubes allows adapting to a greater curvature and/or twist of the cavity 6, particularly in the trailing edge region. Thus, an aerofoil can be provided with better aerodynamics. Possibly cooling of the aerofoil can be improved.

The invention claimed is:

1. A turbine component, comprising:

a hollow aerofoil and an impingement tube located within the hollow aerofoil, wherein the hollow aerofoil includes a cavity including opposed rear and fore portions defined by interior surfaces of respective trailing edge and leading edge regions of the hollow aerofoil, wherein the rear portion includes a sharp edge portion and the fore portion includes a substantially cylindrical portion, wherein the sharp edge portion of the rear portion of the cavity in the trailing edge region has a curved and/or twist shape with a sharp edge at an end, said impingement tube being formed from at least two separate sections corresponding to a rear section and a fore section that are configured to extend span wise through the hollow aerofoil, wherein the rear and fore sections respectively have substantially a same contour as the respective rear and fore portions of the cavity, wherein the rear and fore sections of the impingement tube are connected together by a locking device, said locking device being insertable into the hollow aerofoil so as to urge the rear and fore sections of the impingement tube into locking engagement with portions of the interior surfaces that define the opposed rear and fore portions of the cavity of the hollow aerofoil, wherein said locking device is a roll pin being located in an axially direction between the rear and fore sections of the impingement tube and has a main extension which extends in a radial direction of the hollow aerofoil.

2. The turbine component according to claim 1, wherein said hollow aerofoil comprises a single cavity.

3. The turbine component according to claim 1, wherein at least one of said at least two separate sections extends substantially completely through a span of the hollow aerofoil.

4. The turbine component according to claim 1, wherein the turbine component is a turbine blade or vane.

5. The turbine component according to claim 1, wherein said hollow aerofoil comprises protrusions or locking pins or ribs at an interior surface of said hollow aerofoil.

6. An impingement tube configured to mount within a hollow aerofoil of a turbine component, which hollow aerofoil includes a cavity including opposed rear and fore portions defined by interior surfaces of respective trailing edge and leading edge regions of the hollow aerofoil, wherein the rear portion includes a sharp edge portion and the fore portion includes a substantially cylindrical portion, wherein the sharp edge portion of the rear portion of the cavity in the trailing edge region has a curved and/or twist shape, said impingement tube comprising:

at least two separate sections corresponding to a rear section and a fore section that are configured to extend span wise through the hollow aerofoil, wherein the rear and fore sections respectively have substantially a same contour as the respective rear and fore portions of the cavity, wherein the rear and fore sections of the impingement tube are connected together by a locking device, said locking device being insertable into the hollow aerofoil so as to urge the rear and fore sections of the impingement tube into locking engagement with portions of the interior surfaces that define the opposed rear and fore portions of the cavity of the hollow aerofoil, wherein said locking device is a roll pin being located in an axially direction between the rear and fore sections and has a main extension which extends in a radial direction of the hollow aerofoil when the impingement tube is mounted within the hollow aerofoil.

7. A method for assembling an impingement tube in a hollow aerofoil of a turbine component, which hollow aerofoil includes a cavity including opposed rear and fore portions defined by interior surfaces of respective trailing edge and leading edge regions of the hollow aerofoil, wherein the rear portion includes a sharp edge portion and the fore portion includes a substantially cylindrical portion, wherein the sharp edge portion of the rear portion of the cavity in the trailing edge region has a curved and/or twist shape, wherein the impingement tube is formed from at least two separate sections corresponding to a rear section and a fore section that are configured to extend span wise through the hollow aerofoil, wherein the rear and fore sections respectively have substantially a same contour as the respective rear and fore portions of the cavity, said method comprising:

inserting the rear section of the impingement tube into the hollow aerofoil and maneuvering the rear section in a direction of the trailing edge region of the hollow aerofoil into a position in the rear portion of the cavity of the hollow aerofoil, inserting the fore section of the impingement tube into the hollow aerofoil adjacent to the rear section, connecting the rear and fore sections of the impingement tube together by inserting into the hollow aerofoil a locking device which is a roll pin in an axial direction between the rear and fore sections and which has a main extension which extends in a radial direction of the hollow aerofoil, so as to urge the rear and fore sections of the impingement tube into locking engagement with portions of the interior surfaces that define the opposed rear and fore portions of the cavity of the hollow aerofoil.

8. The method according to claim 7, wherein the fore section of the impingement tube is maneuvered into position in the fore portion of the cavity of the hollow aerofoil.

* * * * *